US012287109B2

(12) United States Patent
Nakai et al.

(10) Patent No.: US 12,287,109 B2
(45) Date of Patent: Apr. 29, 2025

(54) AIR BLOWER

(71) Applicant: DAIKIN INDUSTRIES, LTD., Osaka (JP)

(72) Inventors: Satoshi Nakai, Osaka (JP); Tetsuya Yamashita, Osaka (JP); Hideaki Konishi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/227,462

(22) Filed: Jul. 28, 2023

(65) Prior Publication Data

US 2023/0366582 A1 Nov. 16, 2023

Related U.S. Application Data

(63) Continuation of application No. PCT/JP2022/002909, filed on Jan. 26, 2022.

(30) Foreign Application Priority Data

Jan. 29, 2021 (JP) ..... 2021-013344

(51) Int. Cl.
*F24F 1/0014* (2019.01)
*F24F 11/79* (2018.01)

(52) U.S. Cl.
CPC ..... *F24F 11/79* (2018.01); *F24F 1/0014* (2013.01)

(58) Field of Classification Search
CPC ..... F24F 11/79; F24F 1/0014; F24F 13/1413; F24F 2140/40; F24F 1/52
(Continued)

(56) References Cited

U.S. PATENT DOCUMENTS

2010/0307717 A1* 12/2010 Yamashita ..... F24F 13/22 165/96
2016/0341438 A1* 11/2016 Yaegashi ..... F24F 1/0014

FOREIGN PATENT DOCUMENTS

CN 211345519 U 8/2020
CN 211822783 U 10/2020
(Continued)

OTHER PUBLICATIONS

Gu, Kang, CN211822783 Translation.pdf, "Wall-mounted air conditioner indoor unit", Oct. 2020, pp. 1-12.*
(Continued)

*Primary Examiner* — Michael G Hoang
*Assistant Examiner* — Ryan L Faulkner
(74) *Attorney, Agent, or Firm* — Birch, Stewart, Kolasch & Birch, LLP

(57) ABSTRACT

A disadvantage such as loss of life to a bearing of an indoor fan motor may occur when the number of rotations of the indoor fan falls below a predetermined number of rotations. An indoor unit includes a fan, a casing, a first horizontal flap, a second horizontal flap, and an indoor controller. The casing accommodates the fan, and has a blow-out port through which air provided by the fan is blown out. The indoor controller performs opening and closing operations to bring the first and second horizontal flaps into a first state in decreasing an airflow volume to be blown out through the blow-out port. In the first state, the first horizontal flap is in a position to open a first portion of the blow-out port while the second horizontal flap is in or substantially in a position to close a second portion of the blow-out port.

2 Claims, 5 Drawing Sheets

(58) Field of Classification Search
USPC ..... 454/233
See application file for complete search history.

(56) References Cited

FOREIGN PATENT DOCUMENTS

| | | | |
|---|---|---|---|
| EP | 3 252 401 | A1 | 12/2017 |
| EP | 3 819 555 | A1 | 5/2021 |
| JP | 56-64246 | A | 6/1981 |
| JP | 5-79690 | A | 3/1993 |
| JP | 5-196292 | A | 8/1993 |
| JP | 5-280808 | A | 10/1993 |
| JP | 8-136038 | A | 5/1996 |
| JP | 2001-116327 | A | 4/2001 |
| JP | 2001-227805 | A | 8/2001 |
| JP | 2002-155870 | A | 5/2002 |
| JP | 2010-164268 | A | 7/2010 |
| WO | WO 2016/121623 | A1 | 8/2016 |
| WO | WO 2020/008590 | A1 | 1/2020 |

OTHER PUBLICATIONS

Miki, Masayoshi, JPS5664246 Translation.pdf, "Changing device for injected air direction", Jun. 1981, pp. 1-3.*

Koido, Tetsuya, JPH05196292 Translation.pdf, "Air conditioner", Aug. 1993, pp. 1-11.*

English translation of International Preliminary Report on Patentability and Written Opinion of the International Searching Authority for International Application No. PCT/JP2022/002909, dated Aug. 10, 2023.

Decision to Grant a Patent issued in Japanese Application No. 2021-013344, dated Feb. 17, 2023.

International Search Report (PCT/ISA/210) issued in PCT/JP2022/002909, dated Apr. 12, 2022.

Notice of Reasons for Refusal issued in Japanese Application No. 2021-013344, dated Sep. 27, 2022.

Extended European Search Report for European Application No. 22745930.2, dated May 3, 2024.

* cited by examiner

AIR BLOWER

CROSS REFERENCE TO RELATED APPLICATIONS

This application is a Continuation of PCT International Application No. PCT/JP2022/002909, filed on Jan. 26, 2022, which claims priority under 35 U.S.C. § 119(a) to Patent Application No. JP 2021-013344, filed in Japan on Jan. 29, 2021, all of which are hereby expressly incorporated by reference into the present application.

TECHNICAL FIELD

Embodiments disclosed herein relate to an air blower.

BACKGROUND ART

As disclosed in Patent Literature 1 (JP H08-136038 A), in order to prevent cold air from being blown out through a blow-out port of an indoor unit during, for example, a halt of a heating operation of an air conditioning apparatus, there is a technique for reducing the number of rotations of an indoor fan to decrease the airflow volume to be blown out through the blow-out port.

SUMMARY

A first aspect is directed to an air blower including a fan, a casing, a first opening and closing member, a second opening and closing member, and a control unit. The fan includes a rotator extending in a first direction along a shaft. The casing accommodates the fan, and has a blow-out port through which air provided by the fan is blown out. The first opening and closing member is configured to open and close a first portion of the blow-out port. The second opening and closing member is configured to open and close a second portion of the blow-out port. The control unit is configured to control an opening and closing operation of the first opening and closing member and an opening and closing operation of the second opening and closing member. The first opening and closing member and the second opening and closing member are arranged in the first direction. The control unit controls the opening and closing operations to bring the first and second opening and closing members into a first state in decreasing an airflow volume to be blown out through the blow-out port. In the first state, the first opening and closing member is in a position to open the first portion of the blow-out port while the second opening and closing member is in or substantially in a position to close the second portion of the blow-out port.

DESCRIPTION OF EMBODIMENTS

(1) General Configuration

An air conditioning apparatus 1 is configured to cool air in a target space SP (hereinafter, referred to appropriately as a cooling operation) and heat air in the target space SP (hereinafter, referred to appropriately as a heating operation), with a vapor compression refrigeration cycle. The air conditioning apparatus 1 does not necessary carry out both the cooling operation and the heating operation, and may alternatively be configured to carry out the cooling operation only, for example.

Figure 1:
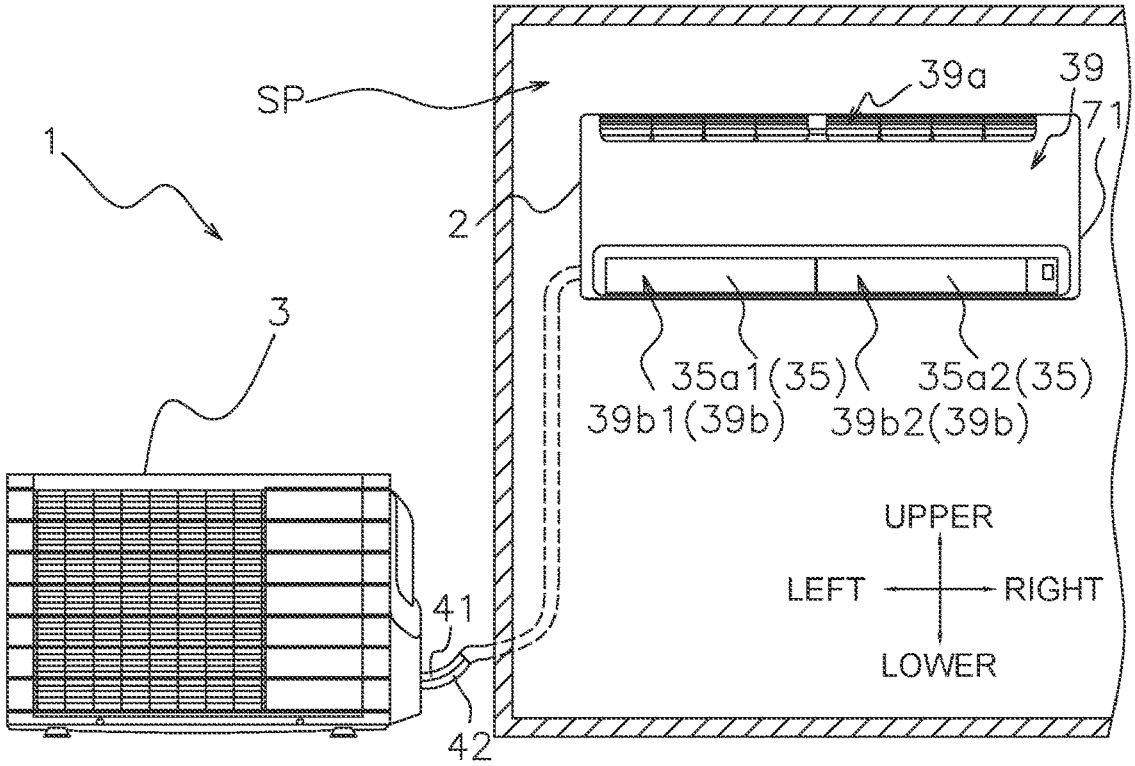
FIG. 1 is a schematic configuration diagram of an air conditioning apparatus.

FIG. 1 is a schematic configuration diagram of the air conditioning apparatus 1. As illustrated in FIG. 1, the air conditioning apparatus 1 mainly includes an outdoor unit 2, an indoor unit 3, and connection pipes 41 and 42. In this embodiment, the air conditioning apparatus 1 includes one indoor unit 3. The air conditioning apparatus 1 may alternatively include a plurality of indoor units 3 connected in parallel. The connection pipes 41 and 42 include the liquid-refrigerant connection pipe 41 and the gas-refrigerant connection pipe 42. The connection pipes 41 and 42 connect the outdoor unit 2 and the indoor unit 3. The connection pipes 41 and 42 are constructed on site in installing the air conditioning apparatus 1.

Figure 2:
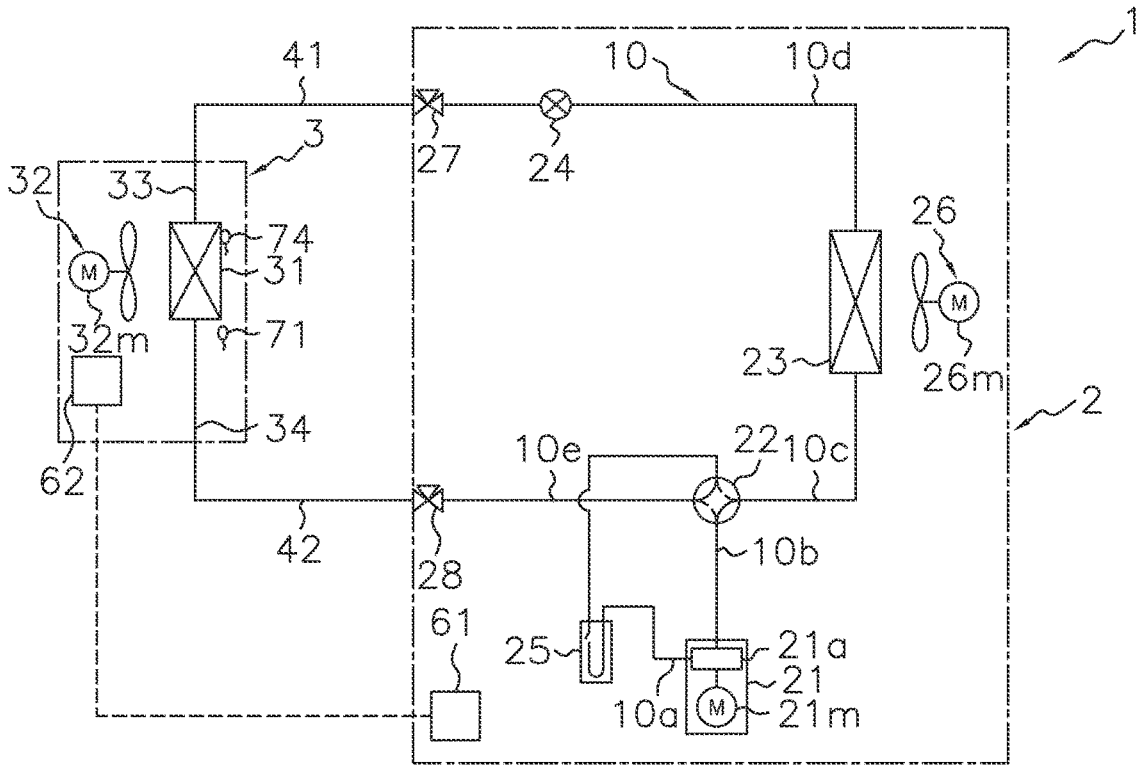
FIG. 2 is a diagram illustrating a refrigerant circuit in the air conditioning apparatus.

FIG. 2 is a diagram illustrating a refrigerant circuit 10 in the air conditioning apparatus 1. In the air conditioning apparatus 1, as illustrated in FIG. 2, the refrigerant circuit 10 is constituted of the outdoor unit 2 and the indoor unit 3 connected with the liquid-refrigerant connection pipe 41 and the gas-refrigerant connection pipe 42. The refrigerant circuit 10 mainly includes a compressor 21, a flow direction switching mechanism 22, an outdoor heat exchanger 23, and an expansion valve 24 of the outdoor unit 2 as well as an indoor heat exchanger 31 of the indoor unit 3.

(2) Specific Configuration

(2-1) Indoor Unit

As illustrated in FIG. 1, the indoor unit 3 (which is an example of an air blower) is placed in the target space SP. In this embodiment, the indoor unit 3 is designed to be hung on a wall. However, the indoor unit 3 is not necessarily designed to be hung on a wall.

Figure 3:
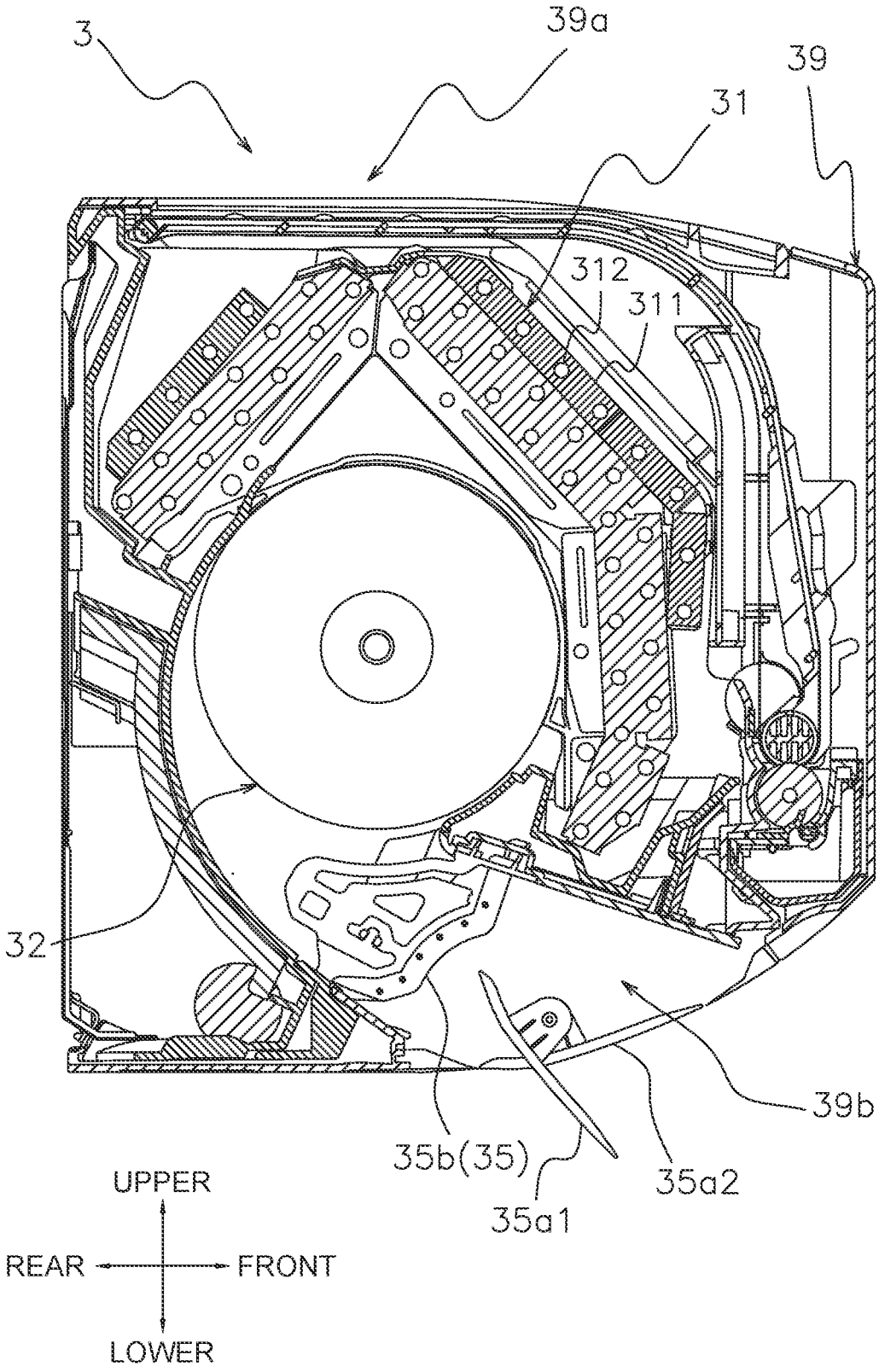
FIG. 3 is a sectional view of an indoor unit.

FIG. 3 is a sectional view of the indoor unit 3. As illustrated in FIGS. 2 and 3, the indoor unit 3 mainly includes an indoor fan 32, a casing 39, a first horizontal flap **35*a*1, a second horizontal flap 35*a*2, and an indoor control unit 62. As illustrated in FIGS. 2 and 3, the indoor unit 3 also includes the indoor heat exchanger 31. The indoor unit 3 also includes various sensors. The indoor unit 3 also includes a liquid-refrigerant pipe 33 connecting the liquid-refrigerant connection pipe 41 and a liquid-side end of the indoor heat exchanger 31, and a gas-refrigerant pipe 34 connecting the gas-refrigerant connection pipe 42 and a gas-side end of the indoor heat exchanger 31**.

(2-1-1) Casing

As illustrated in FIG. 3, the casing 39 accommodates the indoor fan 32. The casing 39 has, in its upper side, a suction port **39*a* through which the indoor fan 32 sucks in air. The casing 39 also has, in its lower side, a blow-out port 39*b* through which the indoor fan 32 blows out air. The indoor unit 3 causes the indoor fan 32 to suck in air in the target space SP through the suction port 39***a* and to blow out air, which has passed through the indoor heat exchanger 31, through the blow-out port 39*b*.

(2-1-2) Indoor Heat Exchanger

The indoor heat exchanger 31 causes a refrigerant flowing through the indoor heat exchanger 31 to exchange heat with air in the target space SP. As illustrated in FIG. 3, the indoor heat exchanger 31 includes a plurality of heat transfer fins 311 and a plurality of heat transfer tubes 312. Each heat transfer tube 312 is folded multiple times, and passes through a corresponding one of the heat transfer fins 311 multiple times. The indoor unit 3 causes the indoor fan 32 to suck in air in the target space SP through the suction port 39*a*. The sucked air in the target space SP then passes between adjacent ones of the plurality of heat transfer fins 311. At this time, the refrigerant flows through each heat transfer tube 312. Therefore, the refrigerant flowing through each heat transfer tube 312 exchanges heat with the air passing between adjacent ones of the plurality of heat transfer fins 311. The air, after passing through the indoor heat exchanger 31, is blown out through the blow-out port 39*b*.

The indoor heat exchanger 31 functions as an evaporator during the cooling operation. The indoor heat exchanger 31 functions as a condenser (a radiator) during the heating operation.

(2-1-3) Indoor Fan

The indoor fan 32 (which is an example of a fan) includes a rotator extending in a left-and-right direction (which is an example of a first direction) along a shaft (see FIG. 1, etc.). In this embodiment, the indoor fan 32 is a cross-flow fan.

As illustrated in FIG. 3, the indoor fan 32 sucks in air through the suction port 39*a*, provides the air to the indoor heat exchanger 31, and blows out the air subjected to heat exchange with the refrigerant in the indoor heat exchanger 31, through the blow-out port 39*b* toward the target space SP.

As illustrated in FIG. 2, the indoor fan 32 is driven by an indoor fan motor 32*m*. The indoor fan motor 32*m* has the number of rotations controllable by an inverter. A predetermined lower limit value (hereinafter, referred to appropriately as a first lower limit value) is set for the number of rotations of the indoor fan motor 32*m*. A disadvantage such as loss of life to a bearing (not illustrated) of the indoor fan motor 32*m* may occur when the number of rotations of the indoor fan motor 32*m* falls below the first lower limit value.

(2-1-4) Flap

As illustrated in FIGS. 1 and 3, a flap 35 is disposed in the blow-out port 39*b*. The flap 35 is configured to adjust a direction of air to be blown out through the blow-out port 39*b*.

The flap 35 includes the first horizontal flap 35*a*1 (which is an example of a first opening and closing member), the second horizontal flap 35*a*2 (which is an example of a second opening and closing member), and a vertical flap 35*b*.

The first horizontal flap 35*a*1 and the second horizontal flap 35*a*2 are each configured to change the direction of air to be blown out through the blow-out port 39*b*, in an up-and-down direction. The first horizontal flap 35*a*1 and the second horizontal flap 35*a*2 are respectively driven by a first horizontal flap motor 35*a*1*m* and a second horizontal flap motor 35*a*2*m* independently of each other. As illustrated in FIG. 1, the first horizontal flap 35*a*1 and the second horizontal flap 35*a*2 are arranged in the left-and-right direction. The first horizontal flap 35*a*1 is configured to open and close a first portion 39*b*1 corresponding to a left-side portion of the blow-out port 39*b*. The second horizontal flap 35*a*2 is configured to open and close a second portion 39*b*2 corresponding to a right-side portion of the blow-out port 39*b*. In the example illustrated in FIG. 1, the first horizontal flap 35*a*1 and second horizontal flap 35*a*2 respectively close the first portion 39*b*1 and second portion 39*b*2 of the blow-out port 39*b*. In the example illustrated in FIG. 3, the first horizontal flap 35*a*1 opens the first portion 39*b*1 of the blow-out port 39*b* while the second horizontal flap 35*a*2 closes the second portion 39*b*2 of the blow-out port 39*b*.

Figure 4:
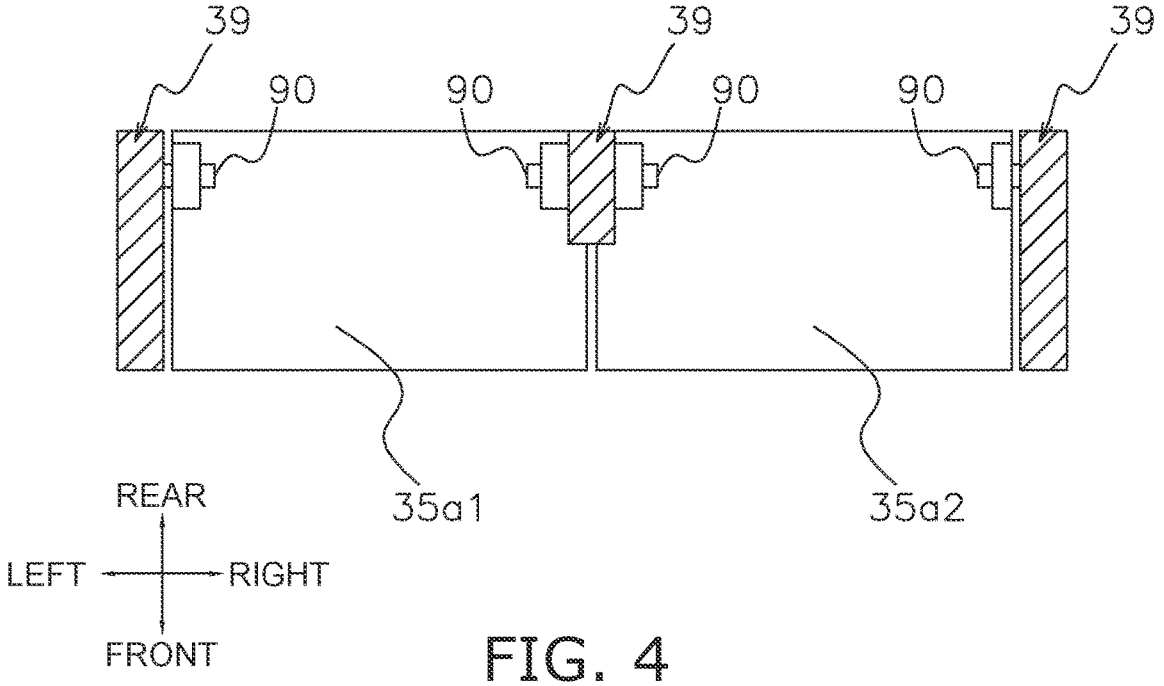
FIG. 4 is a sectional view of a first horizontal flap and a second horizontal flap of the indoor unit and their surroundings.

FIG. 4 is a sectional view of the first horizontal flap 35*a*1 and second horizontal flap 35*a*2 of the indoor unit 3 and their surroundings. As illustrated in FIG. 4, the first horizontal flap 35*a*1 and the second horizontal flap 35*a*2 are connected to the casing 39 with members 90 serving as their shafts, independently of each other.

The vertical flap 35*b* is configured to change the direction of air to be blown out through the blow-out port 39*b*, in the left-and-right direction. The vertical flap 35*b* is driven by a vertical flap motor 35*bm*.

(2-1-5) Sensor

As illustrated in FIG. 2, the indoor unit 3 includes the various sensors including an indoor temperature sensor 71 and an indoor heat-exchanged temperature sensor 74.

The indoor temperature sensor 71 is configured to measure a temperature of air in the target space SP. The indoor temperature sensor 71 is, for example, a thermistor. In this embodiment, as illustrated in FIG. 1, the indoor temperature sensor 71 is disposed on a right side surface of the indoor unit 3.

The indoor heat-exchanged temperature sensor 74 is configured to measure a temperature of the refrigerant flowing through the indoor heat exchanger 31. The indoor heat-exchanged temperature sensor 74 is, for example, a thermistor. As illustrated in FIG. 2, the indoor heat-exchanged temperature sensor 74 is disposed on the indoor heat exchanger 31.

(2-1-6) Indoor Control Unit

The indoor control unit 62 (which is an example of a control unit) is configured to control operations of the respective components of the indoor unit 3.

Figure 5:
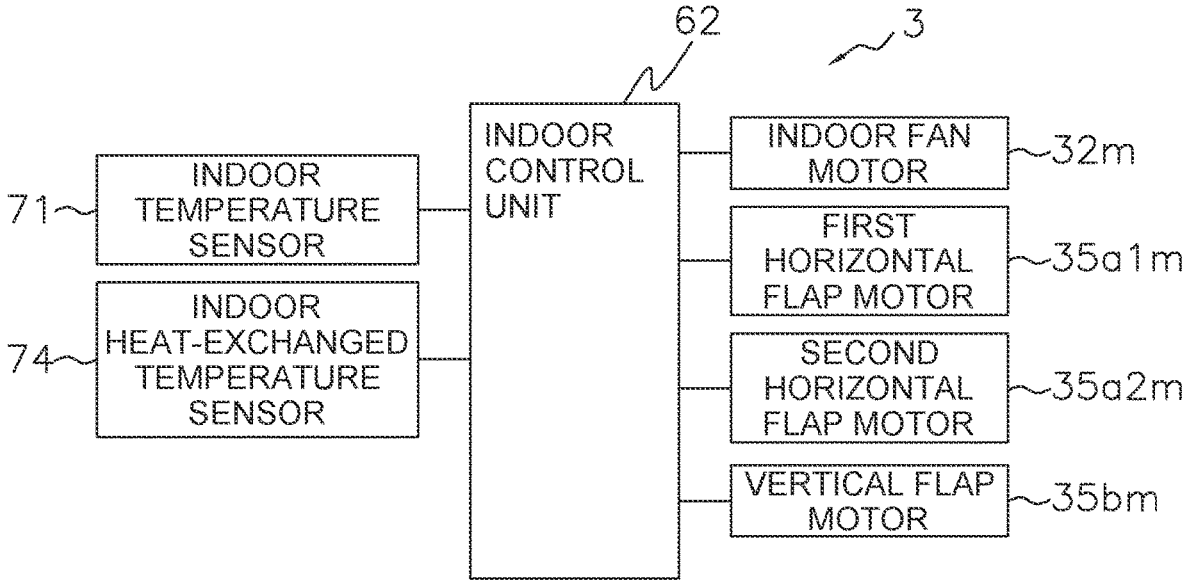
FIG. 5 is a control block diagram of the indoor unit.

FIG. 5 is a control block diagram of the indoor unit 3. As illustrated in FIG. 5, the indoor control unit 62 is electrically connected to various components of the indoor unit 3, such as the indoor fan motor 32*m*, the first horizontal flap motor 35*a*1*m*, the second horizontal flap motor 35*a*2*m*, and the vertical flap motor 35*bm*. The indoor control unit 62 is also communicable with the various sensors of the indoor unit 3, such as the indoor temperature sensor 71 and the indoor heat-exchanged temperature sensor 74.

The indoor control unit 62 includes a control computation device and a storage device. The control computation device is a processor such as a central processing unit (CPU) or a graphics processing unit (GPU). The storage device is a storage medium such as a random access memory (RAM), a read only memory (ROM), or a flash memory. The control computation device reads a program from the storage device and executes predetermined computation processing in accordance with the program, thereby controlling the operations of the respective components of the indoor unit 3. In addition, the control computation device is capable of writing a result of computation in the storage device and reading information from the storage device, in accordance with the program. The indoor control unit 62 also includes a timer.

The indoor control unit 62 is configured to receive various signals from a remote controller (not illustrated) for operating the air conditioning apparatus 1. The various signals include, for example, signals instructing a start and a stop of an operation, and signals for various settings. The signals for various settings include, for example, a signal for a set temperature and a signal for a set humidity. The indoor control unit 62 exchanges, for example, the various signals with an outdoor control unit 61 of the outdoor unit 2, through a communication line. The indoor control unit 62 and the outdoor control unit 61 cooperate to control the entire air conditioning apparatus 1.

Figure 6:
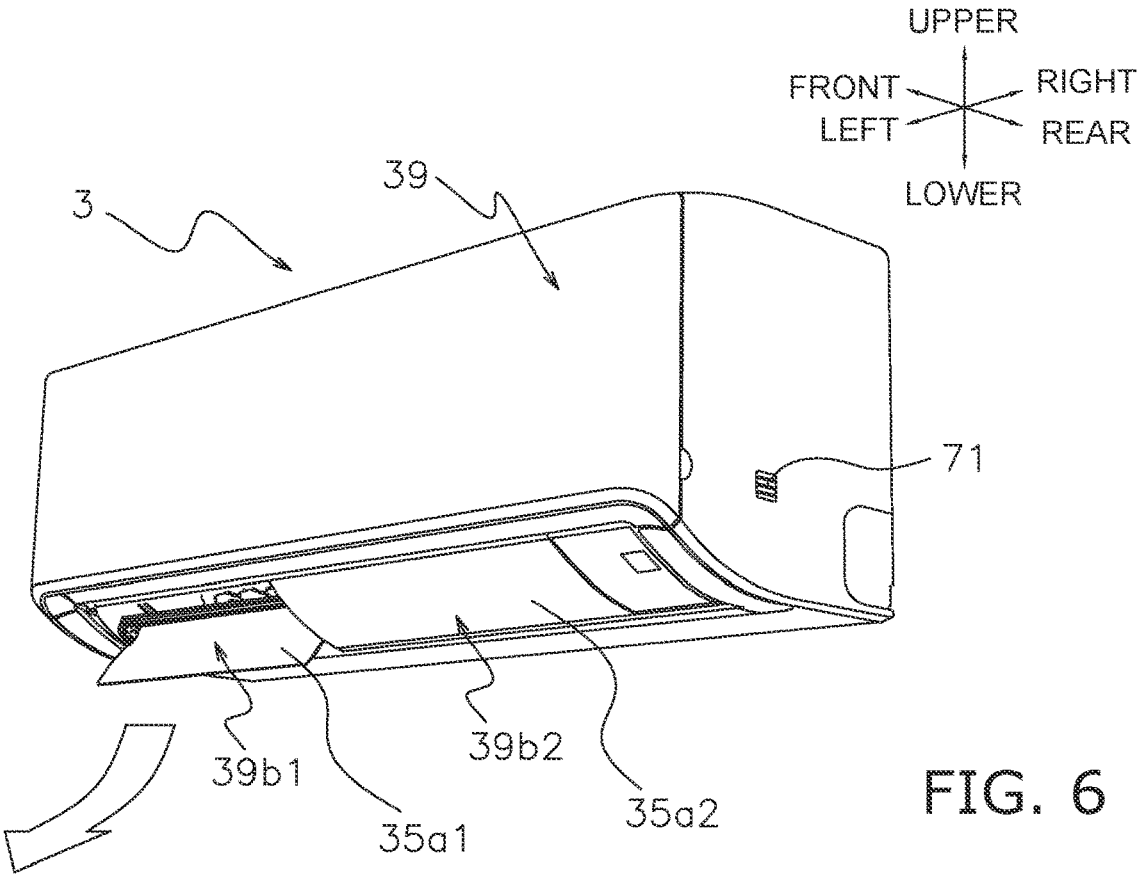
FIG. 6 is a view illustrating the first horizontal flap and the second horizontal flap in a first state.

The indoor control unit 62 mainly controls an opening and closing operation of the first horizontal flap 35*a*1 and an opening and closing operation of the second horizontal flap 35*a*2. Specifically, the indoor control unit 62 controls the opening and closing operations to bring the first horizontal flap 35*a*1 and the second horizontal flap 35*a*2 into a first state, in further decreasing an airflow volume to be blown out through the blow-out port 39*b* after the number of rotations of the indoor fan 32 reaches a first lower limit value. In the first state, the first horizontal flap 35*a*1 is in a position to open the first portion 39*b*1 of the blow-out port 39*b* while the second horizontal flap 35*a*2 is in a position to close the second portion 39*b*2 of the blow-out port 39*b*. FIG. 6 illustrates the first horizontal flap 35*a*1 and the second horizontal flap 35*a*2 in the first state.

(2-2) Outdoor Unit

The outdoor unit 2 may be installed at any place. For example, the outdoor unit 2 is installed on the rooftop of a building where the air conditioning apparatus 1 is installed. Alternatively, the outdoor unit 2 is installed in a machine chamber or is installed around the building.

As illustrated in FIG. 2, the outdoor unit 2 mainly includes, in addition to the compressor 21, flow direction switching mechanism 22, outdoor heat exchanger 23, expansion valve 24, and outdoor control unit 61, an accumulator 25, an outdoor fan 26, a liquid-refrigerant shutoff valve 27, and a gas-refrigerant shutoff valve 28. The outdoor unit 2 also includes various sensors (not illustrated).

As illustrated in FIG. 2, the outdoor unit 2 also includes a suction pipe 10*a*, a discharge pipe 10*b*, a first gas-refrigerant pipe 10*c*, a liquid-refrigerant pipe 10*d*, and a second gas-refrigerant pipe 10*e*. The suction pipe 10*a* connects the flow direction switching mechanism 22 and a suction end of the compressor 21. The discharge pipe 10*b* connects the flow direction switching mechanism 22 and a discharge end of the compressor 21. The first gas-refrigerant pipe 10*c* connects the flow direction switching mechanism 22 and a gas-side end of the outdoor heat exchanger 23. The liquid-refrigerant pipe 10*d* connects the liquid-refrigerant connection pipe 41 and a liquid-side end of the outdoor heat exchanger 23. The liquid-refrigerant pipe 10*d* is provided with the liquid-refrigerant shutoff valve 27 disposed at a joint between the liquid-refrigerant pipe 10*d* and the liquid-refrigerant connection pipe 41. The liquid-refrigerant pipe 10*d* is provided with the expansion valve 24. The second gas-refrigerant pipe 10*e* connects the flow direction switching mechanism 22 and the gas-refrigerant connection pipe 42. The second gas-refrigerant pipe 10*e* is provided with the gas-refrigerant shutoff valve 28 disposed at a joint between the second gas-refrigerant pipe 10*e* and the gas-refrigerant connection pipe 42. The liquid-refrigerant shutoff valve 27 and the gas-refrigerant shutoff valve 28 are openable and closable manually.

(2-2-1) Compressor

As illustrated in FIG. 2, the compressor 21 includes a compression mechanism 21*a* configured to compress and discharge the refrigerant. The compressor 21 changes by compression the low-pressure refrigerant in the refrigeration cycle to the high-pressure refrigerant in the refrigeration cycle. The compressor 21 may be of any type. For example, the compressor 21 is a capacity compressor of a rotary type or a scroll type. The compression mechanism 21*a* of the compressor 21 is driven by a compressor motor 21*m*. The compressor motor 21*m* has the number of rotations controllable by an inverter.

(2-2-2) Flow Direction Switching Mechanism

As illustrated in FIG. 2, the flow direction switching mechanism 22 is configured to change a direction of the refrigerant discharged from the compressor 21. In other words, the flow direction switching mechanism 22 is configured to change a direction of the refrigerant in the refrigerant circuit 10. In this embodiment, the flow direction switching mechanism 22 is a four-way switching valve.

In the air conditioning apparatus 1, the flow direction switching mechanism 22 changes the direction of the refrigerant to switch between the heating operation of the air conditioning apparatus 1 and the cooling operation of the air conditioning apparatus 1.

During the cooling operation, the flow direction switching mechanism 22 causes the suction pipe 10*a* to communicate with the second gas-refrigerant pipe 10*e* and the discharge pipe 10*b* to communicate with the first gas-refrigerant pipe 10*c* as indicated by solid lines in the flow direction switching mechanism 22 illustrated in FIG. 2. As a result of the connections of the refrigerant pipes by the flow direction switching mechanism 22, during the cooling operation, the refrigerant when being discharged from the compressor 21 flows through the outdoor heat exchanger 23, expansion valve 24, and indoor heat exchanger 31 in the refrigerant circuit 10 and then returns to the suction end of the compressor 21. During the cooling operation, the outdoor heat exchanger 23 functions as a condenser while the indoor heat exchanger 31 functions as an evaporator.

During the heating operation, the flow direction switching mechanism 22 causes the suction pipe 10*a* to communicate with the first gas-refrigerant pipe 10*c* and the discharge pipe 10*b* to communicate with the second gas-refrigerant pipe 10*e* as indicated by broken lines in the flow direction switching mechanism 22 illustrated in FIG. 2. As a result of the connections of the refrigerant pipes by the flow direction switching mechanism 22, during the heating operation, the refrigerant when being discharged from the compressor 21 flows through the indoor heat exchanger 31, expansion valve 24, and outdoor heat exchanger 23 in the refrigerant circuit 10 and then returns to the suction end of the compressor 21. During the heating operation, the indoor heat exchanger 31 functions as a condenser while the outdoor heat exchanger 23 functions as an evaporator.

(2-2-3) Outdoor Heat Exchanger

The outdoor heat exchanger 23 may have any structure. For example, the outdoor heat exchanger 23 is a fin-and-tube heat exchanger of a cross-fin type that includes a heat transfer tube (not illustrated) and a plurality of fines (not illustrated). The outdoor heat exchanger 23 causes the refrigerant flowing through the outdoor heat exchanger 23 to exchange heat with heat source air.

The outdoor heat exchanger 23 functions as a condenser during the cooling operation. The outdoor heat exchanger 23 functions as an evaporator during the heating operation.

(2-2-4) Expansion Valve

The expansion valve 24 is an electronic expansion valve whose opening degree is adjustable in, for example, adjusting a flow rate of the refrigerant.

As illustrated in FIG. 2, the expansion valve 24 is disposed on the liquid-refrigerant pipe 10*d*. The expansion valve 24 is configured to decompress the refrigerant flowing from the outdoor heat exchanger 23 toward the indoor heat exchanger 31 or the refrigerant flowing from the indoor heat exchanger 31 toward the outdoor heat exchanger 23.

(2-2-5) Accumulator

The accumulator 25 has a gas-liquid separating function of separating the refrigerant, which flows thereinto, into the gas refrigerant and the liquid refrigerant. As illustrated in FIG. 2, the accumulator 25 is disposed on the suction pipe 10*a*. In other words, the accumulator 25 is disposed upstream of the compressor 21 in the refrigerant flowing direction. In the accumulator 25, the refrigerant is separated into the gas refrigerant and the liquid refrigerant, and the gas refrigerant in the upper space then flows into the compressor 21.

(2-2-6) Outdoor Fan

The outdoor fan 26 is configured to suck, into the outdoor unit 2, heat source air (air in a place where the outdoor unit 2 is installed), to provide the air to the outdoor heat exchanger 23, and to discharge the air subjected to heat exchange with the refrigerant in the outdoor heat exchanger 23, from the outdoor unit 2. The outdoor fan 26 provides air to the outdoor heat exchanger 23 functioning as an evaporator, during the heating operation of the air conditioning apparatus 1.

The outdoor fan 26 is, for example, an axial fan such as a propeller fan. However, the outdoor fan 26 is not limited to an axial fan, and any fan may be selected as appropriate. The outdoor fan 26 is driven by an outdoor fan motor 26*m*. The outdoor fan motor 26*m* has the number of rotations controllable by an inverter.

(2-2-7) Outdoor Control Unit

The outdoor control unit 61 is configured to control operations of the respective components of the outdoor unit 2.

The outdoor control unit 61 is electrically connected to various components of the outdoor unit 2, such as the compressor motor 21*m*, the flow direction switching mechanism 22, the expansion valve 24, and the outdoor fan motor 26*m*. The outdoor control unit 61 is also communicable with the various sensors of the outdoor unit 2.

The outdoor control unit 61 includes a control computation device and a storage device. The control computation device is a processor such as a CPU or a GPU. The storage device is a storage medium such as a RAM, a ROM, or a flash memory. The control computation device reads a program from the storage device and executes predetermined computation processing in accordance with the program, thereby controlling the operations of the respective components of the outdoor unit 2. In addition, the control computation device is capable of writing a result of computation in the storage device and reading information from the storage device, in accordance with the program. The outdoor control unit 61 also includes a timer.

The outdoor control unit 61 exchanges, for example, various signals with the indoor control unit 62 of the indoor unit 3, through a communication line. The outdoor control unit 61 and the indoor control unit 62 cooperate to control the entire air conditioning apparatus 1.

(3) Processing

Figure 8:
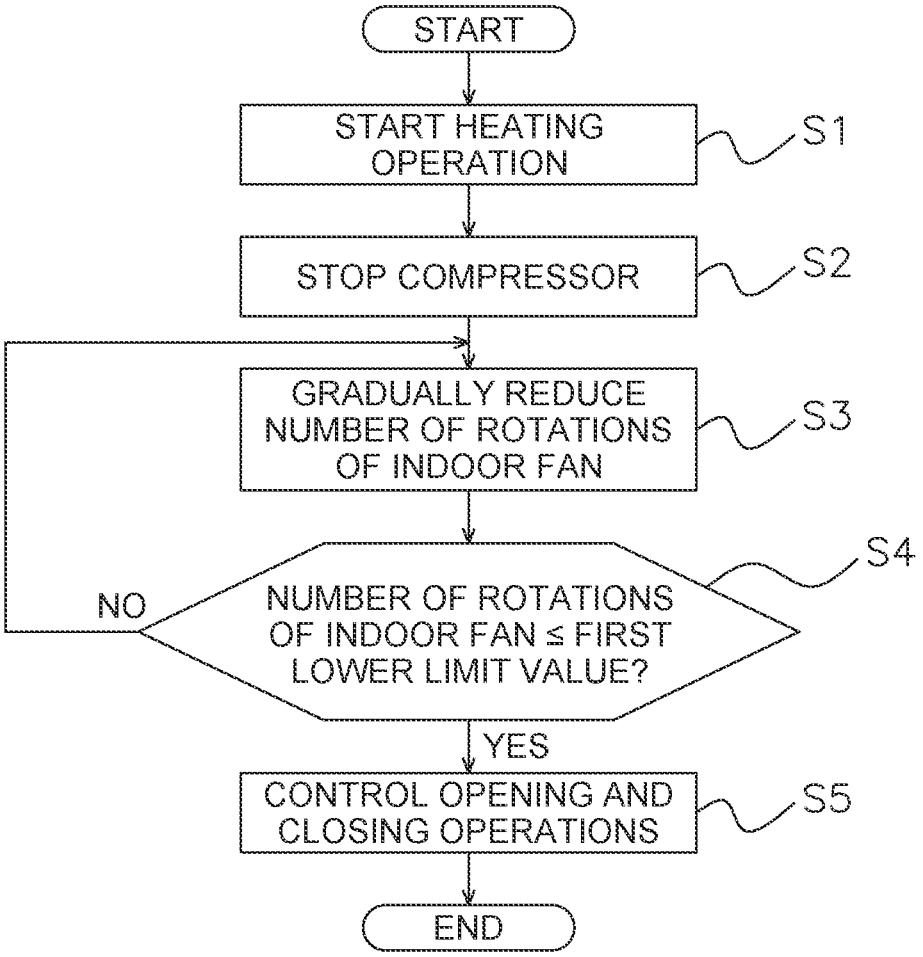
FIG. 8 is a flowchart illustrating exemplary processing by the indoor unit.

Exemplary processing by the indoor unit 3 is described with reference to a flowchart of FIG. 8.

In step S1, the indoor unit 3 starts the heating operation in cooperation with the outdoor unit 2.

In step S2 subsequent to step S1, for example, the indoor unit 3 halts the compressor 21 in cooperation with the outdoor unit 2 for the purpose of energy saving since a temperature, which has been measured by the indoor temperature sensor 71, of air in the target space SP is higher than a set temperature by a predetermined value or more.

In step S3 subsequent to step S2, the indoor unit 3 reduces the number of rotations of the indoor fan 32 to decrease the airflow volume to be blown out through the blow-out port 39*b*, in order to prevent cold air from being blown out through the blow-out port 39*b* in response to a reduction in temperature, which has been measured by the indoor heat-exchanged temperature sensor 74, of the refrigerant flowing through the indoor heat exchanger 31.

In step S4 subsequent to step S3, the indoor unit 3 determines whether the number of rotations of the indoor fan 32 has reached the first lower limit value. When the indoor unit 3 determines that the number of rotations of the indoor fan 32 has reached the first lower limit value, the processing proceeds to step S5. The indoor unit 3, when determining that the number of rotations of the indoor fan 32 does not reach the first lower limit value, further reduces the number of rotations of the indoor fan 32.

In step S5 subsequent to step S4, the indoor unit 3 controls the opening and closing operations to bring the first horizontal flap 35*a*1 and the second horizontal flap 35*a*2 into the first state as illustrated in step S5.

(4) Features (4-1)

Heretofore, in order to prevent cold air from being blown out through a blow-out port of an indoor unit during, for example, a halt of a heating operation of an air conditioning apparatus, there is a technique for reducing the number of rotations of an indoor fan to decrease the airflow volume to be blown out through the blow-out port.

Reducing the number of rotations of an indoor fan so as to decrease the airflow volume to be blown out through a blow-out port may cause a disadvantage such as loss of life to a bearing of an indoor fan motor when the number of rotations of the indoor fan falls below a predetermined number of rotations. Reducing the number of rotations of the indoor fan causes a decrease in velocity of air to be blown out through the blow-out port, which may cause backflow of air to the blow-out port and generation of abnormal sound. Moreover, decreasing the velocity of air to be blown out through the blow-out port causes a reduction in blow distance of air to be blown out through the blow-out port, which may cause a hot air pool or a cold air pool around the indoor unit. As a result, there is a possibility that an indoor temperature sensor fails to accurately measure an indoor temperature.

The indoor unit 3 according to this embodiment includes the indoor fan 32, the casing 39, the first horizontal flap 35*a*1, the second horizontal flap 35*a*2, and the indoor control unit 62. The indoor fan 32 includes the rotator extending in the left-and-right direction along the shaft. The casing 39 accommodates the indoor fan 32, and has the blow-out port 39*b* through which air provided by the indoor fan 32 is blown out. The first horizontal flap 35*a*1 is configured to open and close the first portion 39*b*1 of the blow-out port 39*b*. The second horizontal flap 35*a*2 is configured to open and close the second portion 39*b*2 of the blow-out port 39*b*.

The indoor control unit 62 is configured to control the opening and closing operation of the first horizontal flap 35*a*1 and the opening and closing operation of the second horizontal flap 35*a*2. The first horizontal flap 35*a*1 and the second horizontal flap 35*a*2 are arranged in the left-and-right direction. The indoor control unit 62 controls the opening and closing operations to bring the first horizontal flap 35*a*1 and the second horizontal flap 35*a*2 into the first state, in further decreasing the airflow volume to be blown out through the blow-out port 39*b* after the number of rotations of the indoor fan 32 reaches the first lower limit value. In the first state, the first horizontal flap 35*a*1 is in the position to open the first portion 39*b*1 of the blow-out port 39*b* while the second horizontal flap 35*a*2 is in the position to close the second portion 39*b*2 of the blow-out port 39*b*.

In the indoor unit 3 according to this embodiment, the indoor control unit 62 controls the opening and closing operations to bring the first horizontal flap 35*a*1 and the second horizontal flap 35*a*2 into the first state, in further decreasing an airflow volume to be blown out through the blow-out port 39*b* after the number of rotations of the indoor fan 32 reaches the first lower limit value. In the first state, the first horizontal flap 35*a*1 is in the position to open the first portion 39*b*1 of the blow-out port 39*b* while the second horizontal flap 35*a*2 is in the position to close the second portion 39*b*2 of the blow-out port 39*b*.

The indoor unit 3 thus avoids a situation in which air is blown out through the second portion 39*b*2 of the blow-out port 39*b* due to idle of the indoor fan 32 on the side closer to the second horizontal flap 35*a*2. This configuration therefore allows the indoor unit 3 to decrease the airflow volume to be blown out through the blow-out port 39*b* while maintaining the predetermined number of rotations of the indoor fan 32 at the first lower limit value. This configuration also allows the indoor unit 3 to keep the air to be blown out through the blow-out port 39*b* at a fixed velocity. This configuration thus prevents backflow of air to the blow-out port 39*b* and generation of abnormal sound. This configuration allows the indoor unit 3 to keep the air to be blown out through the blow-out port 39*b* at a fixed velocity. This configuration therefore suppresses a hot air pool or a cold air pool around the indoor unit 3. As a result, the indoor temperature sensor 71 is capable of accurately measuring an indoor temperature.

(5) Modifications

(5-1) Modification 1A

In the foregoing embodiment, the indoor control unit 62 controls the opening and closing operations to bring the first horizontal flap 35*a*1 and the second horizontal flap 35*a*2 into the first state.

Figure 7:
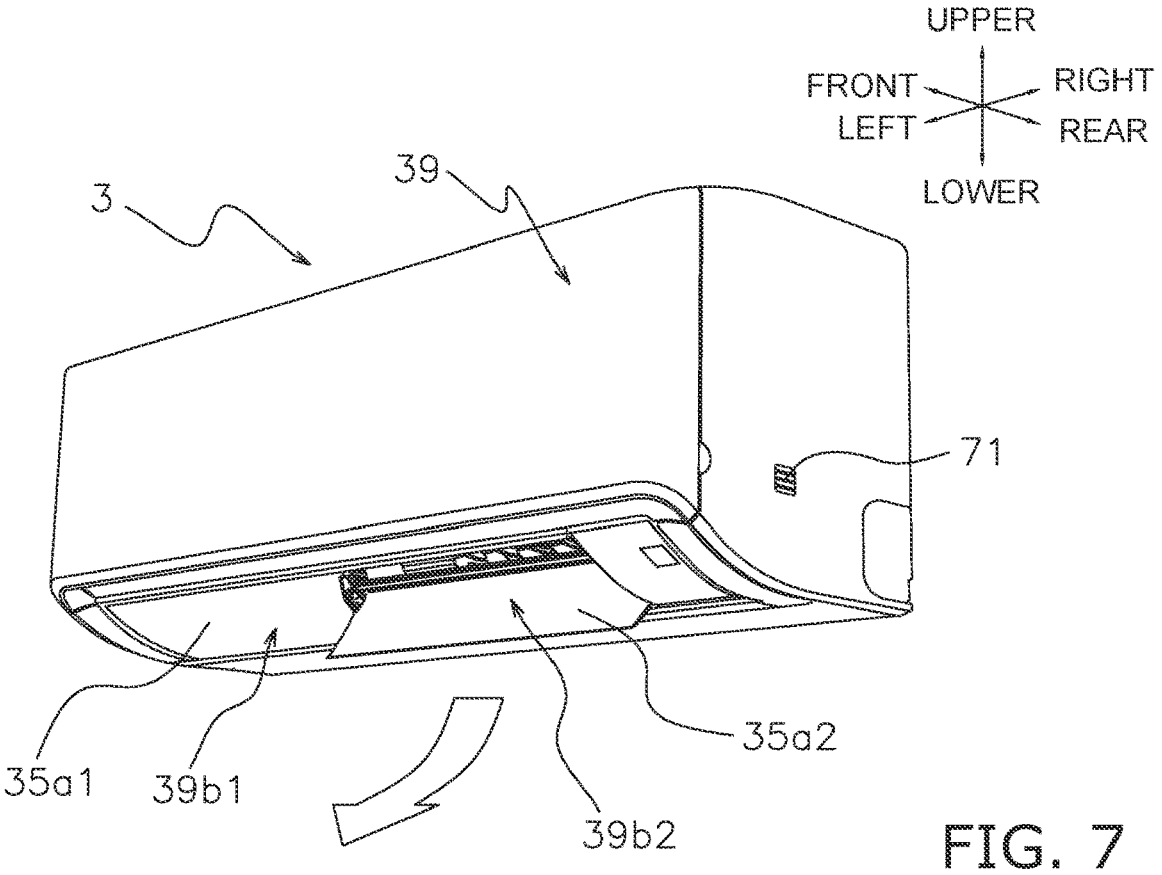
FIG. 7 is a view illustrating the first horizontal flap and the second horizontal flap in a second state.

The indoor control unit 62 may alternatively control the opening and closing operations so as to bring the first horizontal flap 35*a*1 and the second horizontal flap 35*a*2 into the first state and a second state alternately. In the second state, the first horizontal flap 35*a*1 is in a position to close the first portion 39*b*1 of the blow-out port 39*b* while the second horizontal flap 35*a*2 is in a position to open the second portion 39*b*2 of the blow-out port 39*b*. FIG. 7 illustrates the first horizontal flap 35*a*1 and the second horizontal flap 35*a*2 in the second state.

The indoor control unit 62 may bring the first horizontal flap 35*a*1 and the second horizontal flap 35*a*2 into the first state and the second state alternately every predetermined time. The predetermined time is, for example, five minutes.

For example, when the second horizontal flap 35*a*2 is always in the position to close the second portion 39*b*2 of the blow-out port 39*b*, the temperature of the refrigerant flowing through the indoor heat exchanger 31 decreases (i.e., the indoor heat exchanger 31 is cooled), so that the second horizontal flap 35*a*2 is cooled by radiation, which results in dew condensation on the surface of the second horizontal flap 35*a*2. In view of this, the indoor unit 3 brings the first horizontal flap 35*a*1 and the second horizontal flap 35*a*2 into the first state and the second state alternately. Air provided by the indoor fan 32 thus flows around the first horizontal flap 35*a*1 and the second horizontal flap 35*a*2 to suppress dew condensation on the surfaces of the first horizontal flap 35*a*1 and second horizontal flap 35*a*2.

(5-2) Modification 1B

In the foregoing embodiment, in the first state, the second horizontal flap 35*a*2 is in the position to close the second portion 39*b*2 of the blow-out port 39*b*. Alternatively, in the first state, the second horizontal flap 35*a*2 may be substantially in the position to close the second portion 39*b*2 of the blow-out port 39*b*.

According to Modification 1A described above, in the second state, the first horizontal flap 35*a*1 is in the position to close the first portion 39*b*1 of the blow-out port 39*b*. Alternatively, in the second state, the first horizontal flap 35*a*1 may be substantially in the position to close the first portion 39*b*1 of the blow-out port 39*b*.

It should be noted that the opening degree of the first horizontal flap 35*a*1 (or the second horizontal flap 35*a*2) substantially in the position to close the first portion 39*b*1 (or the second portion 39*b*2) is smaller by, for example, 20% or less than the opening degree of the first horizontal flap 35*a*1 (or the second horizontal flap 35*a*2) in the position to open the first portion 39*b*1 (or the second portion 39*b*2).

When the first horizontal flap 35*a*1 and the second horizontal flap 35*a*2 are each in the slightly open position, air provided by the indoor fan 32 flows around the first horizontal flap 35*a*1 and the second horizontal flap 35*a*2. The indoor unit 3 is thus capable of suppressing dew condensation on the surfaces of the first horizontal flap 35*a*1 and second horizontal flap 35*a*2.

(5-3) Modification 1C

In the foregoing embodiment, the indoor unit 3 controls the opening and closing operations of the two horizontal flaps (each of which is an example of an opening and closing member) disposed at the blow-out port 39*b*. The indoor unit 3 may alternatively control opening and closing operations of three or more horizontal flaps (each of which is an example of an opening and closing member) disposed at the blow-out port 39*b*.

The indoor unit 3 is thus capable of finely adjusting the airflow volume to be blown out through the blow-out port 39*b*, while maintaining the predetermined number of rotations of the indoor fan 32 at the first lower limit value.

(5-4) Modification 1D

In the foregoing embodiment, the indoor unit 3 controls the opening and closing operations in halting the compressor 21 and then reducing the number of rotations of the indoor fan 32. The indoor unit 3 may alternatively control the opening and closing operations in reducing the number of rotations of the indoor fan 32 prior to a halt of the compressor 21.

(5-5)

While various embodiments of the present disclosure have been described herein above, it is to be appreciated that various changes in form and detail may be made without departing from the spirit and scope of the present disclosure presently or hereafter claimed.

REFERENCE SIGNS LIST

3: indoor unit (air blower)
32: indoor fan (fan)
39: casing
35*a*1: first horizontal flap (first opening and closing member)
35*a*2: second horizontal flap (second opening and closing member)
39*b*: blow-out port
39*b*1: first portion
39*b*2: second portion
62: indoor control unit (control unit)

CITATION LIST

Patent Literature

Patent Literature 1: JP H08-136038 A

The invention claimed is:

1. An air blower comprising:

a fan including a rotator extending in a first direction along a shaft;

a casing accommodating the fan, and having a blow-out port through which air provided by the fan is blown out;

a first opening and closing member configured to open and close a first portion of the blow-out port;

a second opening and closing member configured to open and close a second portion of the blow-out port; and a controller configured to control an opening and closing operation of the first opening and closing member and an opening and closing operation of the second opening and closing member, wherein the first opening and closing member and the second opening and closing member are arranged in the first direction, the controller controls, in decreasing an airflow volume to be blown out through the blow-out port, the opening and closing operations to bring the first opening and closing member and the second opening and closing member into a first state in which the first opening and closing member is in a position to open the first portion of the blow-out port while the second opening and closing member is substantially in a position to close the second portion of the blow-out port, with a number of rotations of the fan maintained at or above a predetermined lower limit value, in the first state, an opening degree of the second opening and closing member is 20% or less than an opening degree of the second opening and closing member to open the second portion of the blow-out port, the controller controls the opening and closing operations in further decreasing the airflow volume to be blown out through the blow-out port after the number of rotations of the fan reaches the predetermined lower limit value, and in an operation in which each of the first and second opening and closing members is in the first state, the controller maintains the number of rotations of the fan at the predetermined lower limit value to enable the air to be blown out of the blow-out port at a fixed velocity.

2. The air blower according to claim 1, wherein the controller controls the opening and closing operations to bring the first opening and closing member and the second opening and closing member alternately into the first state and a second state in which the first opening and closing member is substantially in a position to close the first portion of the blow-out port while the second opening and closing member is in a position to open the second portion of the blow-out port, and in the second state, an opening degree of the first opening and closing member is 20% or less than an opening degree of the first opening and closing member to open the first portion of the blow-out port.

* * * * *